US008830158B2

(12) United States Patent
Park et al.

(10) Patent No.: US 8,830,158 B2
(45) Date of Patent: Sep. 9, 2014

(54) METHOD OF LOCAL DIMMING A LIGHT SOURCE, LIGHT SOURCE APPARATUS FOR PERFORMING THE METHOD, AND DISPLAY APPARATUS HAVING THE LIGHT SOURCE APPARATUS

(75) Inventors: Se-Ki Park, Suwon-si (KR); Gi-Cherl Kim, Yongin-si (KR); Dong-Min Yeo, Daegu (KR); Hoi-Sik Moon, Cheonan-si (KR); Si-Joon Song, Suwon-si (KR); Ho-Sik Shin, Anyang-si (KR)

(73) Assignee: Samsung Display Co., Ltd. (KR)

( * ) Notice: Subject to any disclaimer, the term of this patent is extended or adjusted under 35 U.S.C. 154(b) by 848 days.

(21) Appl. No.: 12/407,984

(22) Filed: Mar. 20, 2009

(65) Prior Publication Data

US 2009/0267890 A1 Oct. 29, 2009

(30) Foreign Application Priority Data

Apr. 29, 2008 (KR) ..... 2008-39783
Jun. 24, 2008 (KR) ..... 2008-59826

(51) Int. Cl.
*G09G 3/36* (2006.01)
*G09G 3/34* (2006.01)

(52) U.S. Cl.
CPC ..... *G09G 3/3426* (2013.01); *G09G 2320/0626* (2013.01); *G09G 2320/064* (2013.01); *G09G 2310/0237* (2013.01); *G09G 2320/066* (2013.01); *G09G 2330/021* (2013.01); *G09G 2360/16* (2013.01); *G09G 2310/024* (2013.01)
USPC ..... 345/102

(58) Field of Classification Search
USPC ..... 345/76–83, 102
See application file for complete search history.

(56) References Cited

U.S. PATENT DOCUMENTS

| | | | | |
|---|---|---|---|---|
| 7,064,740 | B2 * | 6/2006 | Daly | 345/102 |
| 8,111,223 | B2 * | 2/2012 | Yeo et al. | 345/82 |
| 2007/0132708 | A1 | 6/2007 | Pan et al. | |
| 2007/0152926 | A1 | 7/2007 | Kwon | |
| 2007/0152954 | A1 | 7/2007 | Daly | |
| 2008/0150853 | A1 * | 6/2008 | Peng et al. | 345/87 |
| 2009/0140665 | A1 * | 6/2009 | Park | 315/291 |

FOREIGN PATENT DOCUMENTS

| | | | |
|---|---|---|---|
| JP | 2004294767 | A | 10/2004 |
| JP | 2005258403 | A | 9/2005 |
| JP | 2007183608 | A | 7/2007 |
| JP | 2007187974 | A | 7/2007 |
| JP | 2007219234 | A | 8/2007 |
| KR | 1020040062152 | A | 7/2004 |
| KR | 1020050112952 | A | 12/2005 |
| KR | 1020070070915 | A | 7/2007 |

OTHER PUBLICATIONS

European Search Report for 09004108.8-2205 dated Aug. 20, 2009.
European Office Action for Application No. 09 004 108.8-1904 dated Mar. 26, 2013.

* cited by examiner

*Primary Examiner* — Jimmy H Nguyen
(74) *Attorney, Agent, or Firm* — Cantor Colburn LLP

(57) ABSTRACT

In a method of local dimming a light source, which includes driving a light source including a plurality of light-emitting blocks by individually driving the light-emitting blocks, the dimming level of each light-emitting block is determined. In the method, the luminance of a first light-emitting area may be adjusted according to a size of the first light-emitting area corresponding to a display area in which an image having a maximum luminance is displayed.

19 Claims, 14 Drawing Sheets

METHOD OF LOCAL DIMMING A LIGHT SOURCE, LIGHT SOURCE APPARATUS FOR PERFORMING THE METHOD, AND DISPLAY APPARATUS HAVING THE LIGHT SOURCE APPARATUS

This application claims priority to Korean Patent Application No. 2008-39783, filed on Apr. 29, 2008, and Korean Patent Application No. 2008-59826, filed on Jun. 24, 2008, and all the benefits accruing therefrom under 35 U.S.C. §119, the contents of which are herein incorporated by reference in their entireties.

BACKGROUND OF THE INVENTION

1. Field of the Invention

Exemplary embodiments of the present invention relate to a method of local dimming a light source, a light source apparatus for performing the method, and a display apparatus having the light source apparatus. More particularly, exemplary embodiments of the present invention relate to a method of local dimming a light source, which is used for driving a light source including a plurality of light-emitting blocks by individually driving the light-emitting blocks, a light source apparatus for performing the method, and a display apparatus having the light source apparatus.

2. Description of the Related Art

Generally, a liquid crystal display ("LCD") apparatus includes an LCD panel displaying an image using optical transmittance of liquid crystal molecules and a backlight assembly disposed below the LCD panel to provide the LCD panel with light.

The LCD panel includes an array substrate, a color filter substrate and a liquid crystal layer. The array substrate includes a plurality of pixel electrodes and a plurality of thin-film transistors ("TFTs") electrically connected to the pixel electrodes. The color filter substrate faces the array substrate and has a common electrode and a plurality of color filters. The liquid crystal layer is interposed between the array substrate and the color filter substrate.

When an electric field generated between the pixel electrode and the common electrode is applied to the liquid crystal layer, the arrangement of liquid crystal molecules of the liquid crystal layer is altered to change the optical transmissivity of the liquid crystal layer, so that an image is displayed. The LCD panel displays a white image of a high luminance when an optical transmittance is increased to maximum, and the LCD panel displays a black image of a low luminance when an optical transmittance is decreased to minimum.

However, the LCD apparatus may produce more glare compared to other types of display apparatuses, such as cathode ray tube ("CRT") and plasma display panel ("PDP") display devices. The LCD apparatus displays an image by using the backlight assembly to generate light, so that the luminance distribution of the LCD apparatus may be different from the luminance distribution of a CRT or a PDP display device. Therefore, the LCD apparatus may cause increased user eye strain.

Recently, in order to increase the contrast ratio of an image and to decrease the power consumption, a method of local dimming a light source has been developed, which individually controls amounts of light according to positions of light sources to drive the light sources. In the method of local dimming the light source, the light source is divided into a plurality of light-emitting blocks to control the amounts of light of the light-emitting blocks in correspondence with dark and bright areas of a display area of an LCD panel corresponding to the light-emitting blocks.

BRIEF SUMMARY OF THE INVENTION

Exemplary embodiments of the present invention provide a method of local dimming a light source capable of enhancing display quality.

Exemplary embodiments of the present invention also provide a light source apparatus for performing the above-mentioned method.

Exemplary embodiments of the present invention also provide a display apparatus having the above-mentioned light source apparatus.

According to exemplary embodiments of the present invention, there is provided one method of local dimming a light source, which includes driving a light source including a plurality of light-emitting blocks by individually driving the light-emitting blocks. In the method, the luminance of a first light-emitting area is adjusted according to a size of the first light-emitting area corresponding to a display area in which an image having a maximum luminance is displayed.

According to one aspect of the present invention, there is provided one exemplary method of local dimming a light source, which includes driving a light source including a plurality of driving blocks having an I×J matrix structure (wherein I and J are natural numbers), each of the driving blocks having the light-emitting blocks having an i×j matrix structure (wherein i and j are natural numbers). In the method, i×j driving signals are generated. Each of the I×J driving signals time-shares to supply the I×J driving blocks.

According to another aspect of the present invention, an exemplary light source apparatus includes a light source module and a local dimming driving part. The light source module comprises a plurality of light-emitting blocks, and supplies light to a display panel. The local dimming driving part adjusts a luminance of a first light-emitting area of the light source module according to a size of the first light-emitting area corresponding to an area of the display panel in which an image having a maximum luminance is displayed.

According to still another aspect of the present invention, an exemplary display apparatus includes a display panel, a light source module and a local dimming driving part. The display panel comprises a plurality of display blocks to display images. The light source module supplies light to the display panel, and comprises a plurality of light-emitting blocks in correspondence with the display blocks. The local dimming driving part adjusts the luminance of a first light-emitting area of the light source module according to a size of the first light-emitting area corresponding to an area of the display panel in which an image having a maximum luminance is displayed.

According to some exemplary embodiments of the present invention, the luminance of a light-emitting area is adjusted according to the size of the light-emitting area corresponding to a display area in which an image having a maximum luminance is displayed, so that the contrast ratio may be enhanced and glare may be reduced.

BRIEF DESCRIPTION OF THE DRAWINGS

The above and other features and advantages of the present invention will become more apparent by describing in detailed exemplary embodiments thereof with reference to the accompanying drawings, wherein.

DETAILED DESCRIPTION OF THE INVENTION

Figure 1:
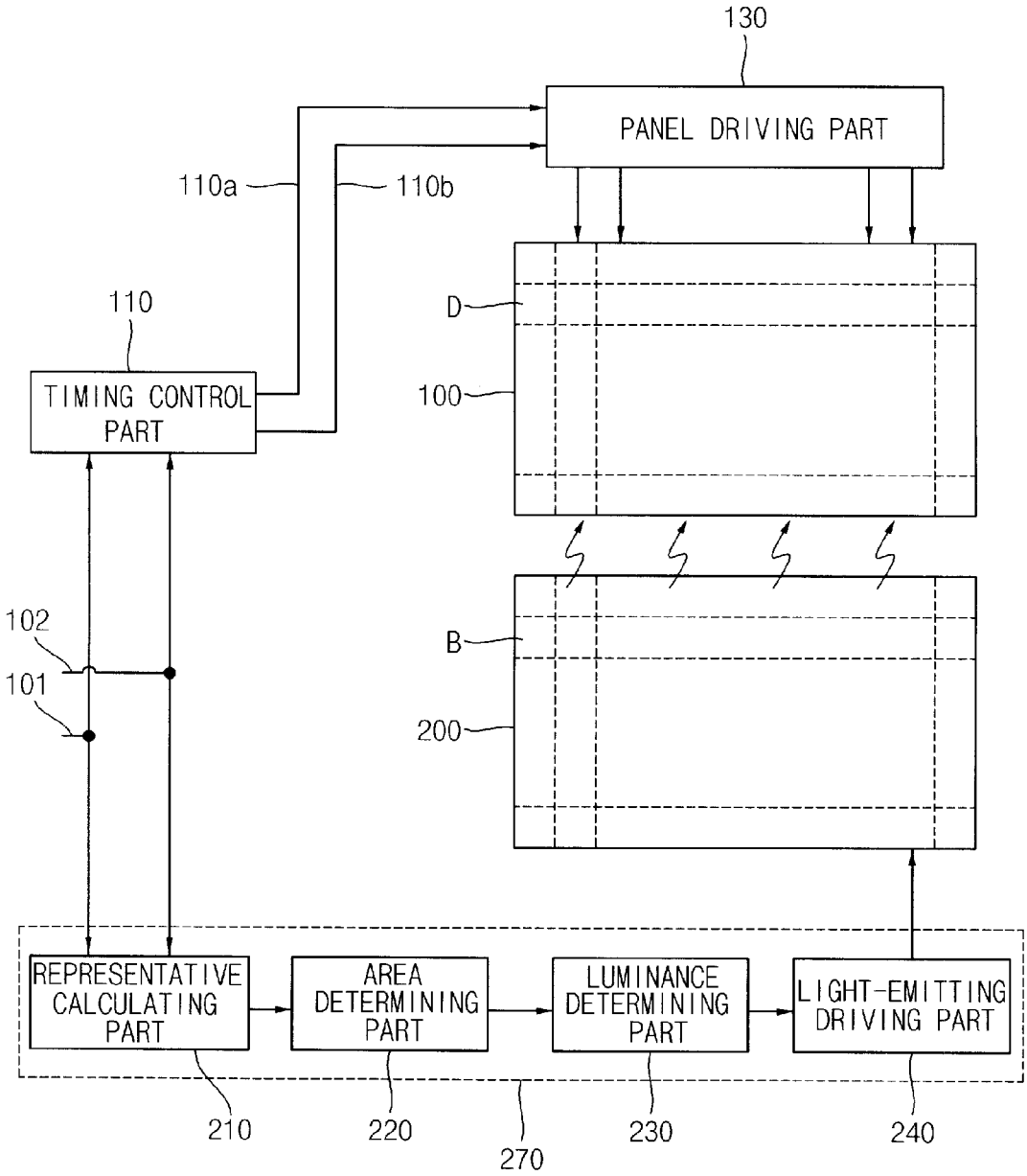
FIG. 1 is a block diagram illustrating an exemplary display apparatus according to an exemplary embodiment of the present invention.

The present invention is described more fully hereinafter with reference to the accompanying drawings, in which exemplary embodiments of the present invention are shown. The present invention may, however, be embodied in many different forms and should not be construed as limited to the exemplary embodiments set forth herein. Rather, these exemplary embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular exemplary embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the invention are described herein with reference to schematic illustrations of exemplary embodiments (and intermediate structures) of the present invention. As such, variations from the shapes of the illustrations as a result, for example, of manufacturing techniques and/or tolerances, are to be expected. Thus, exemplary embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

FIG. 1 is a block diagram illustrating an exemplary display apparatus according to an exemplary embodiment of the present invention.

Referring to FIG. 1, a display apparatus includes a display panel 100, a timing control part 110, a panel driving part 130, a light source module 200 and a local dimming driving part 270.

The display panel 100 includes a plurality of pixels P displaying an image. For example, the number of pixels P may be M×N (wherein M and N are natural numbers). Each pixel P includes a switching element TR connected to a gate line GL and a data line DL, a liquid crystal capacitor CLC and a storage capacitor CST that are connected to the switching element TR. The display panel 100 may include a plurality of display blocks D. The number of the display blocks D is m×n (wherein m and n are natural numbers, m<M and n<N).

The timing control part 110 may receive a control signal 101 and an image signal 102 from an external device (not shown). The timing control part 110 generates a timing control signal 110*a* which controls a driving timing of the display panel 100 by using the received control signal 101. The timing control signal 110*a* includes a clock signal, a horizontal start signal and a vertical start signal. As shown, the timing control part 110 may receive the control signal 101 and the image signal 102 through the local dimming driving part 270.

The panel driving part 130 drives the display panel 100 by using the timing control signal 110*a* provided from the timing control part 110 and an image signal 110*b*. For example, the panel driving part 130 may include a gate driving part and a data driving part. The gate driving part generates a gate signal by using the timing control signal 110*a*, and provides the gate line GL with the gate signal. The data driving part generates a data signal by using the timing control signal 110*a* and the image signal 110*b*, and provides the data line DL with the data signal.

The light source module 200 includes a printed circuit board ("PCB") having a plurality of light-emitting diodes ("LEDs") mounted thereon. For example, the LEDs may include a red LED which generates red light, a green LED which generates green light, a blue LED which generates blue light and a white LED which generates white light. Alternatively, the LED may include a white LED which generates white light. The light source module 200 may include m×n light-emitting blocks B in correspondence with m×n display blocks D. The light-emitting blocks B are disposed in a position corresponding to each of the display blocks D. Each of the light-emitting blocks B includes a plurality of LEDs.

The local dimming driving part 270 includes a representative calculating part 210, an area determining part 220, a luminance determining part 230, and a light-emitting driving part 240.

The representative calculating part 210 calculates a representative gray scale of each of the display blocks D by using the image signal 102 that is provided from an external device. The representative gray scale may be an average gray scale, a maximum gray scale, etc. The representative gray scale may be determined by various formulas.

The area determining part 220 determines a light-emitting area of the light-emitting block B corresponding to the display block D by using the representative gray scale and a reference value that is a set value. For example, when the representative gray scale is greater than the reference value, the area determining part 220 may determine the light-emitting block B to be a first light-emitting area that has a maximum luminance. When the representative gray scale is lower than the reference value, the area determining part 220 determines the light-emitting block B to be a second light-emitting area that has a normal luminance. The reference value may be a white gray scale, the maximum luminance may be the luminance of an image having the white gray scale, and the normal luminance may be the luminance of an image having a middle gray scale.

The luminance determining part 230 determines a first luminance level corresponding to the first light-emitting area, and a second luminance level corresponding to the second light-emitting area. The first luminance level is determined by the size of the first light-emitting area with respect to the size of the light source module 200 having the light-emitting blocks B of m×n. For example, the first luminance level may become larger as the size of the first light-emitting area becomes smaller, and the first luminance level may become smaller as the size of the first light-emitting area becomes larger. When the size of the first light-emitting area is a minimum, the first luminance level may be a maximum. The second luminance level is determined by using a gamma curve and a representative gray scale of a light-emitting block B in the second light-emitting area. The gamma curve includes the relation between the representative gray scale and a luminance.

The light-emitting driving part 240 generates a plurality of driving signals which drive the light-emitting blocks B. The light-emitting driving part 240 generates the driving signals that control the light emission of the light-emitting blocks B in the first light-emitting area, and generates the driving signals that control the light emission of the light-emitting blocks B in the second light-emitting area.

Therefore, the light-emitting blocks B in the first light-emitting area generate light of high luminance when the size of the first light-emitting area is small. The light-emitting blocks B in the first light-emitting area generate light of low luminance when the size of the first light-emitting area is large.

Hereinafter, a driving method of the luminance determining part 240 will be explained. That is, a method of determining the luminance level using the size of the light-emitting areas and the representative gray scale will be explained.

Figure 2:
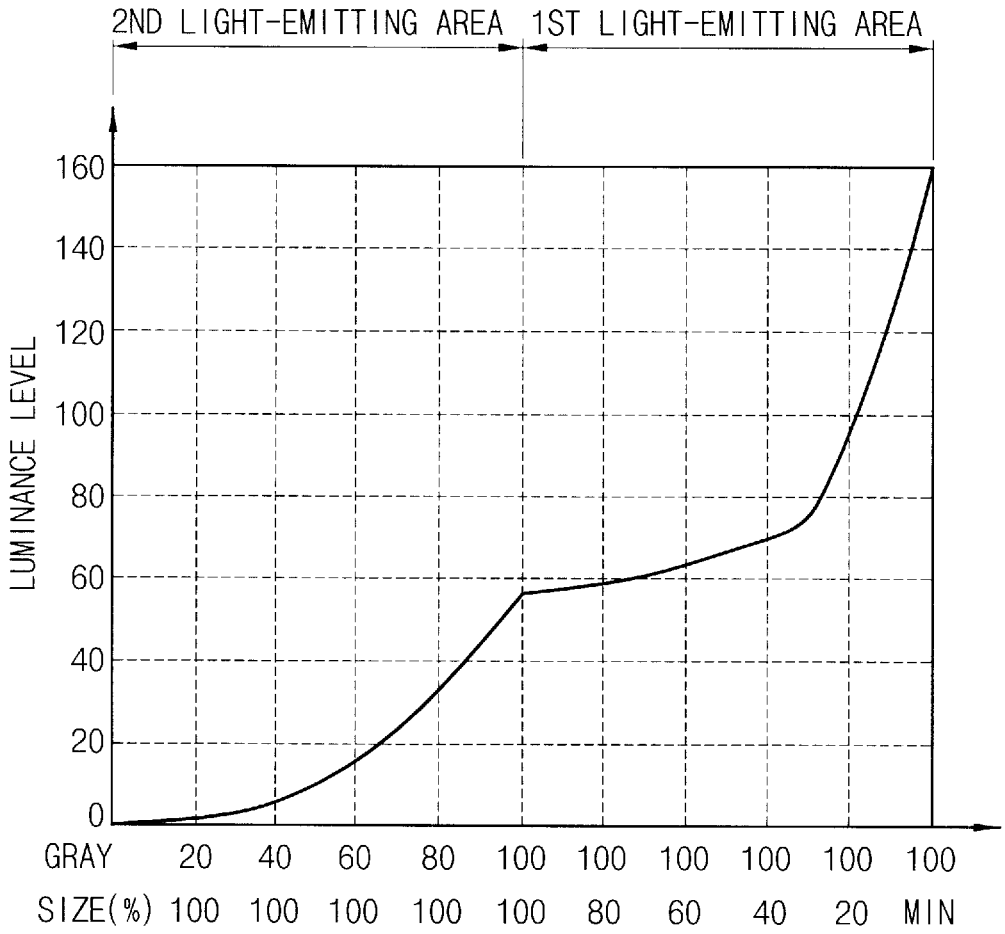
FIG. 2 is a graph illustrating the relation between the size and the luminance of a light-emitting area of FIG. 1.

FIG. 2 is a graph illustrating the relation between the size and the luminance of light-emitting area of FIG. 1.

Referring to FIGS. 1 and 2, when the entire area of the light source module 200 is determined to be the second light-emitting area, i.e. 100% second light-emitting area, the light-emitting block of the second light-emitting area has the representative gray scale lower than the reference value.

The luminance determining part 230 determines the second luminance level by using the representative gray scale of the light-emitting block B corresponding to the second light-emitting area and the gamma curve. For example, the luminance determining part 230 may obtain a maximum representative gray scale among representative gray scales of the light-emitting blocks B corresponding to the second light-emitting area, and obtains a luminance corresponding to the maximum representative gray scale by using the gamma curve. The luminance determining part 230 determines the second luminance level based on the luminance corresponding to the maximum representative gray scale. As shown in FIG. 2, the luminance determining part 230 increases the second luminance level when the representative gray scale is increased.

When the entire area of the light source module 200 is determined to be the first and second light-emitting areas, i.e. the first light-emitting area occupies some of the area of the light source module 200, the light-emitting block B of the first light-emitting area has the representative gray scale higher than the reference value, and the light-emitting block B of the second light-emitting area has the representative gray scale lower than the reference value.

The luminance determining part 230 determines the first luminance level of the first light-emitting area according to the size of the first light-emitting area. The luminance determining part 230 increases the first luminance level as the size of the first light-emitting area becomes smaller, and decreases the first luminance level as the size of the first light-emitting area becomes larger. A boosting mode is that in which the luminance level of the first light-emitting area is suddenly increased as the size of the first light-emitting area becomes smaller. For example, a normal luminance of the full white may be about 500 nits, and the luminance of the first light-emitting area driven by the boosting mode may be about 1,000 nits. The power consumption of the light source module 200 is always fixed regardless of the size of the first light-emitting area.

The luminance determining part 230 determines the second luminance level of the second light-emitting area by using the representative gray scales of the light-emitting blocks in the second light-emitting area and the gamma curve.

When the entire area of the light source module 200 is determined to be the first light-emitting area, the light-emitting block of the first light-emitting area has the representative gray scale higher than the reference value.

The luminance determining part 230 determines the first luminance level of the first light-emitting area. The first luminance level is a middle luminance level with respect to the luminance level range, and the middle luminance level is higher than an average luminance level of a cathode ray tube ("CRT") or a plasma display panel ("PDP"). As shown in FIG. 2, when the luminance level range is from 0 to 160, the first luminance level is determined to be about 60. The luminance of the first light-emitting area is lower than about 500 nits of such by about 300 nits, when the normal luminance of the full white is about 500 nits.

Therefore, when the entire area of the light source module 200 is determined to be the first light-emitting area, a liquid crystal display ("LCD") apparatus according to the exemplary embodiment has a luminance that is higher than the luminance of a CRT or a PDP. When the entire area of the light source module 200 is determined to be occupied by both the first and second light-emitting areas, the luminance of the first light-emitting area is increased, such as the exponential curve, as the size of the first light-emitting area is decreased, so that the LCD apparatus according to the exemplary embodiment may have an improved contrast ratio in comparison with a CRT or a PDP.

Figure 3A:
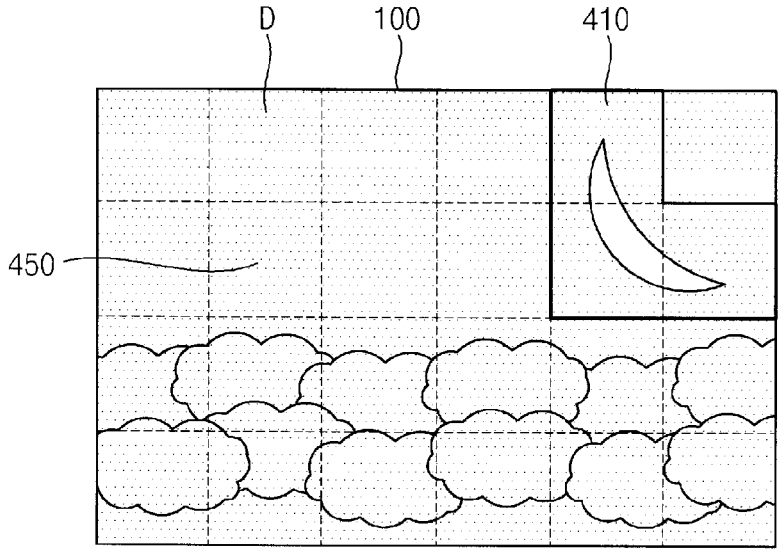
FIG. 3A is a plan view illustrating an image according to one exemplary embodiment displayed on a display panel of FIG. 1.
Figure 3B:
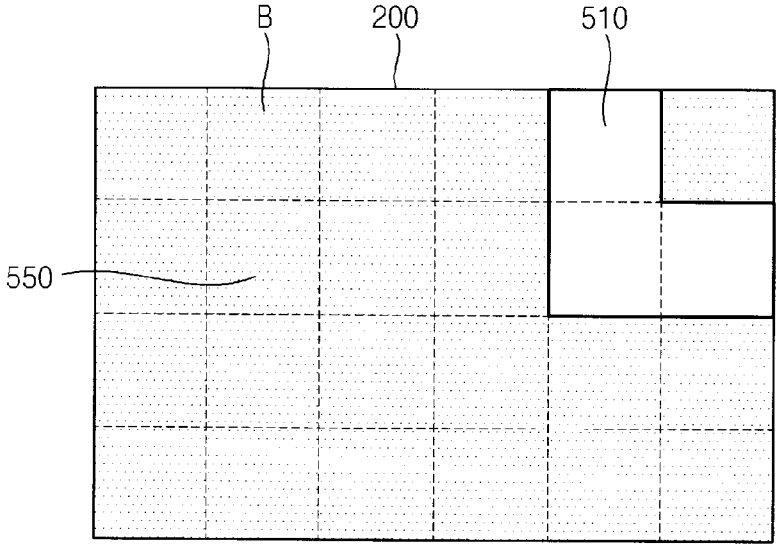
FIG. 3B is a plan view illustrating an exemplary light source module corresponding to the image of FIG. 3A.

FIG. 3A is a plan view illustrating an image according to one embodiment displayed on an exemplary display panel of FIG. 1. FIG. 3B is a plan view illustrating an exemplary light source module corresponding to the image of FIG. 3A.

Referring to FIG. 3A, the display panel 100 is divided into the display blocks D. The representative gray scale of each of the display blocks D is compared with the reference value, so that the display panel 100 is divided into first and second display areas 410 and 450. The first display area 410 includes the display blocks D that have the representative gray scale higher than the reference value. The second display area 450 includes the display blocks D that have the representative gray scale lower than the reference value. The representative gray scale may be an average gray scale, a maximum gray scale, etc. The representative gray scale may be determined by various formulas.

Referring to FIG. 3B, the light source module 200 is divided into the light-emitting blocks B. The light-emitting blocks B are divided into the first and the second light-emitting areas 510 and 550 corresponding to the first and second display areas 410 and 450.

The first luminance level is determined according to the size of the first light-emitting area. For example, when the size of the first light-emitting area 510 is about 15% with respect to the entire light-emitting area of the light source module 200, the first luminance level may be determined to be about 118 with reference to FIG. 2. Therefore, the first light-emitting area 510 may be driven by the boosting mode.

The second luminance level is determined by using the representative gray scales of the display blocks D corresponding to the second light-emitting area 550 and the gamma curve. The gamma curve may be set by various variables. The second luminance level may be separately determined corresponding to each of the light-emitting blocks B in the second light-emitting area 550. In addition, the luminance level of a light-emitting block B within the second light-emitting area 550 may be compensated by various modes using the luminance level of peripheral light-emitting blocks B positioned in a peripheral area of the light-emitting block B. For example, the luminance level of the light-emitting block B may be compensated by using a compensating matrix having a size such as 3×3, 16×16, P×Q (wherein P and Q are natural numbers), etc. The second luminance level is determined to be about 10 to about 30 referring to FIG. 2.

Therefore, by the boosting mode, the first light-emitting area 510 has the high luminance and the second light-emitting area 550 has the low luminance, so that the contrast ratio may be improved. In addition, the driving power of the second light-emitting area 550 is concentrated to the first light-emitting area 510, so that the power consumption of the light source module 200 may be fixed regardless of the size of the first light-emitting area.

Figure 4A:
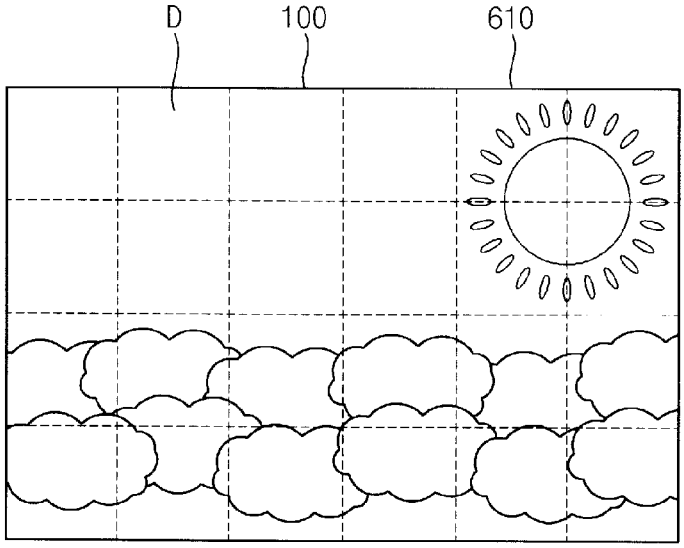
FIG. 4A is a plan view illustrating an image according to another exemplary embodiment displayed on a display panel of FIG. 1.
Figure 4B:
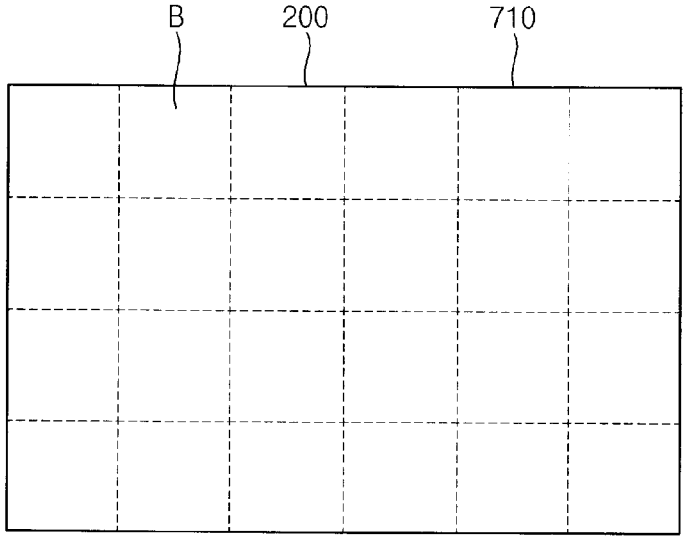
FIG. 4B is a plan view illustrating an exemplary light source module corresponding to the image of FIG. 4A.

FIG. 4A is a plan view illustrating an image according to another exemplary embodiment displayed on an exemplary display panel of FIG. 1. FIG. 4B is a plan view illustrating an exemplary light source module corresponding to the image of FIG. 4A.

Referring to FIG. 4A, the display panel 100 is divided into the display blocks D. The display panel 100 only includes the first display area 610, and therefore does not include a second display area. All of the representative gray scales of the first display blocks D are higher than the reference value.

Referring to FIG. 4B, the light source module 200 is divided into the light-emitting blocks B. The first light-emitting area 710 includes the light-emitting blocks B corresponding to the first display area 610. The light source module 200 does not include a second light-emitting area. The first luminance level is determined according to the size of the first light-emitting area 710. For example, when the size of the first light-emitting area 710 is about 100% with respect to the entire light-emitting area of the light source module 200, the first luminance level may be determined to be about 58 referring to FIG. 2. Therefore, the first light-emitting area 710 is driven by the boosting mode.

Referring to FIG. 2, when the size of the first light-emitting area 710 is a maximum, such as 100%, the first luminance level is a minimum, such as about 58, among the luminance range of about 58 to about 160.

Normally, when the display panel displays a white image, the light source module generates light of a maximum luminance so that the LCD apparatus produces glare to users. However, according to the exemplary embodiment, when the display panel displays a white image, the light source module generates light of a lower luminance than the maximum luminance so that glare may be reduced.

In addition, the first luminance level of the first light-emitting area 710 is decreased, so that the power consumption of the light source module 200 may be decreased.

Figure 5:
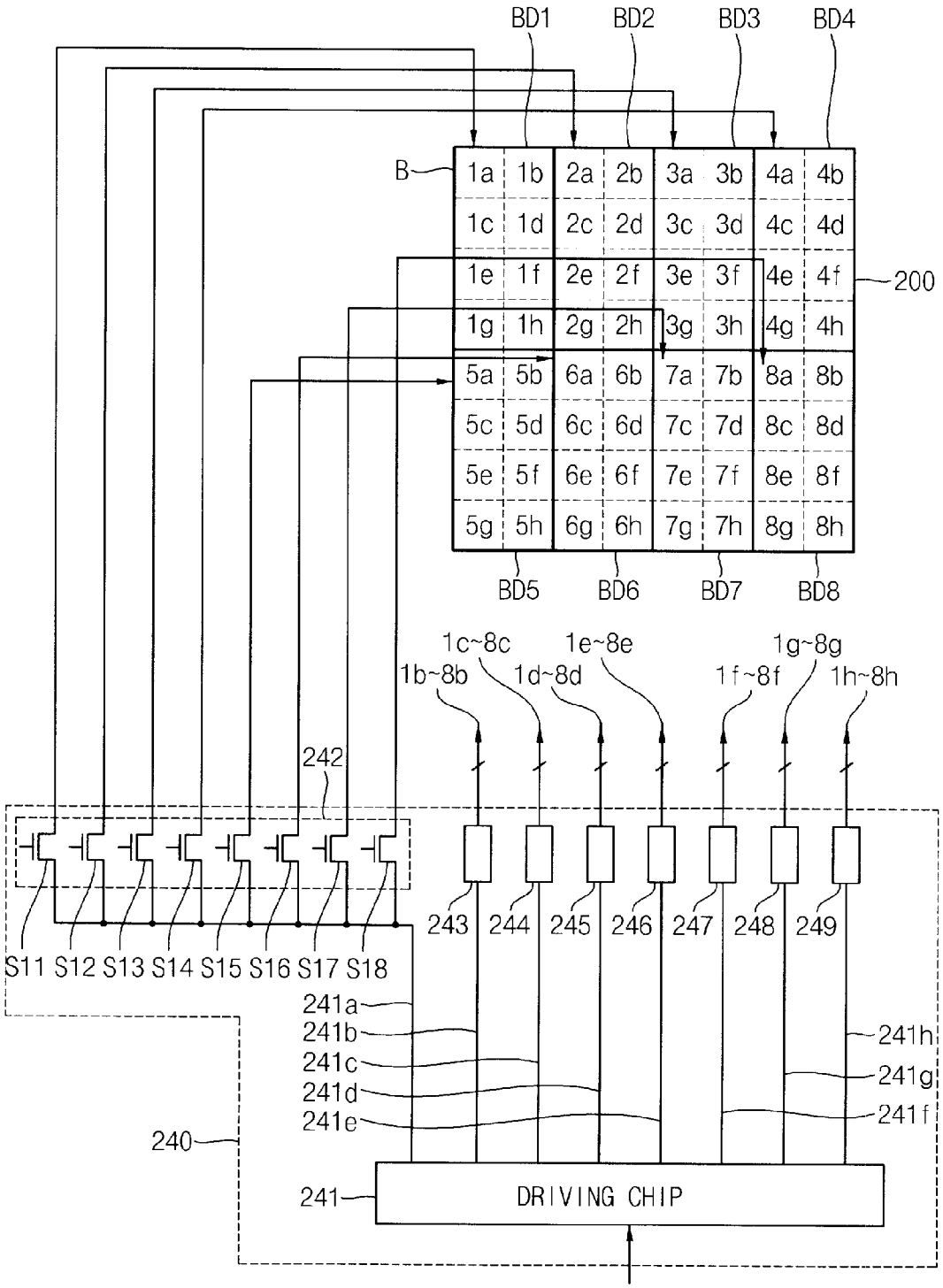
FIG. 5 is a circuit diagram illustrating the exemplary light-emitting driving part of FIG. 1.

FIG. 5 is a circuit diagram illustrating an exemplary light-emitting driving part of FIG. 1.

Referring to FIGS. 1 and 5, the light-emitting driving part 240 includes a driving chip 241 and a plurality of switching parts 242, . . . , 249. The light-emitting driving part 240 drives the light source module 200.

The light source module 200 includes a plurality of light-emitting blocks having an i×j matrix structure (wherein i and j are natural numbers). The light-emitting blocks are divided into a plurality of driving blocks having an I×J matrix structure (wherein I and J are natural numbers).

For example, as shown in FIG. 5, the light source module 200 may include the light-emitting blocks B having an 8×8 matrix structure, and the light-emitting blocks may be divided into eight driving blocks BD1, . . . , BD8. The driving blocks BD1, . . . , BD8 may have a 4×2 matrix structure.

A first driving block BD1 includes a first light-emitting block to an eighth light-emitting block 1*a*, . . . , 1*h*. A second driving block BD2 includes a first light-emitting block to an eighth light-emitting block 2*a*, . . . , 2*h*. A third driving block BD3 includes a first light-emitting block to an eighth light-emitting block 3*a*, . . . , 3*h*. A fourth driving block BD4 includes a first light-emitting block to an eighth light-emitting block 4*a*, . . . , 4*h*. A fifth driving block BD5 includes a first light-emitting block to an eighth light-emitting block 5*a*, . . . , 5*h*. A sixth driving block BD6 includes a first light-emitting block to an eighth light-emitting block 6*a*, . . . , 6*h*. A seventh driving block BD7 includes a first light-emitting block to an eighth light-emitting block 7*a*, . . . , 7*h*. An eighth driving block BD8 includes a first light-emitting block to an eighth light-emitting block 8*a*, . . . , 8*h*.

The driving chip 241 includes the i×j output channels For example, the number of the output channels may correspond to the number of the light-emitting blocks in each of the driving blocks. Thus, the driving chip 241 may include the eight output channels 241*a* (not shown), . . . , 241*h* corresponding to the eight light-emitting blocks in each of the driving blocks BD1, . . . , BD8.

The switching parts 242, 243, . . . , 249 are connected to the output channels, respectively. A switching part 242 includes the I×J switching elements that are connected to an output channel 241*a* to be parallel with each other. Thus, the switching part 242 includes the eight switching elements S11, S12, . . . , S18.

Each of the switching elements S11, S12, . . . , S18 of the switching part 242 includes an input terminal receiving a driving signal outputted from the output channel 241*a*, a control terminal receiving a control signal and an output terminal electrically connected to a respective light-emitting block of the light source module 200. Each of the switching elements S11, S12, . . . , S18 outputs the driving signal to the respective light-emitting block in response to the control signal outputted from the control terminal. The control signal is outputted from the driving chip 241.

The driving chip 241 outputs first to eighth driving signals to the first to eighth driving blocks BD1, . . . , BD8 through the first to eighth output channels 241*a*, 241*b*, . . . , 241*h*. The first output channel 241*a* is electrically connected to first light-emitting blocks 1*a*, . . . , 8*a* of the driving blocks BD1, . . . , BD8 through the first switching part 242. The first switching part 242 time-shares the first driving signal outputted from the first output channel 241*a* to output the first driving signal to the first light-emitting blocks 1*a*, . . . , 8*a*. The first light-emitting blocks 1*a*, . . . , 8*a* receive the first driving signal to emit light when the switching elements S11, S12, . . . , S18 are turned on. The first light-emitting blocks 1*a*, . . . , 8*a* cut off the first driving signal to are turned off when the switching elements S11, S12, . . . , S18 are turned off.

Thus, the second switching part 243 time-shares the second driving signal outputted from the second output channel 241*b* to output the second driving signal to the second light-emitting blocks 1*b*, . . . , 8*b*. The third switching part 244 time-shares the third driving signal outputted from the third output channel 241*c* to output the third driving signal to the third light-emitting blocks 1*c*, . . . , 8*c*. The fourth switching part 245 time-shares the fourth driving signal outputted from the fourth output channel 241*d* to output the fourth driving signal to the fourth light-emitting blocks 1*d*, . . . , 8*d*. The fifth switching part 246 time-shares the fifth driving signal outputted from the fifth output channel 241*e* to output the fifth driving signal to the fifth light-emitting blocks 1*e*, . . . , 8*e*. The sixth switching part 247 time-shares the sixth driving signal outputted from the sixth output channel 241*f* to output the sixth driving signal to the sixth light-emitting blocks 1*f*, . . . , 8*f* The seventh switching part 248 time-shares the seventh driving signal outputted from the seventh output channel 241*g* to output the seventh driving signal to the seventh light-emitting blocks 1*g*, . . . , 8*g*. The eighth switching part 249 time-shares the eighth driving signal outputted from the eighth output channel 241*h* to output the eighth driving signal to the eighth light-emitting blocks 1*h*, . . . , 8*h*.

The light-emitting driving part 240 drives the light source module 200 by using the luminance level outputted from the luminance determining part 230. For example, the light-emitting driving part 240 may extend a time of supplying the driving signal to the first light-emitting area based on the first luminance level to boost the luminance of the first light-emitting area to a high luminance. The light-emitting driving part 240 drives the second light-emitting area based on the second luminance level, so that the second light-emitting area has a normal luminance.

Figure 6:
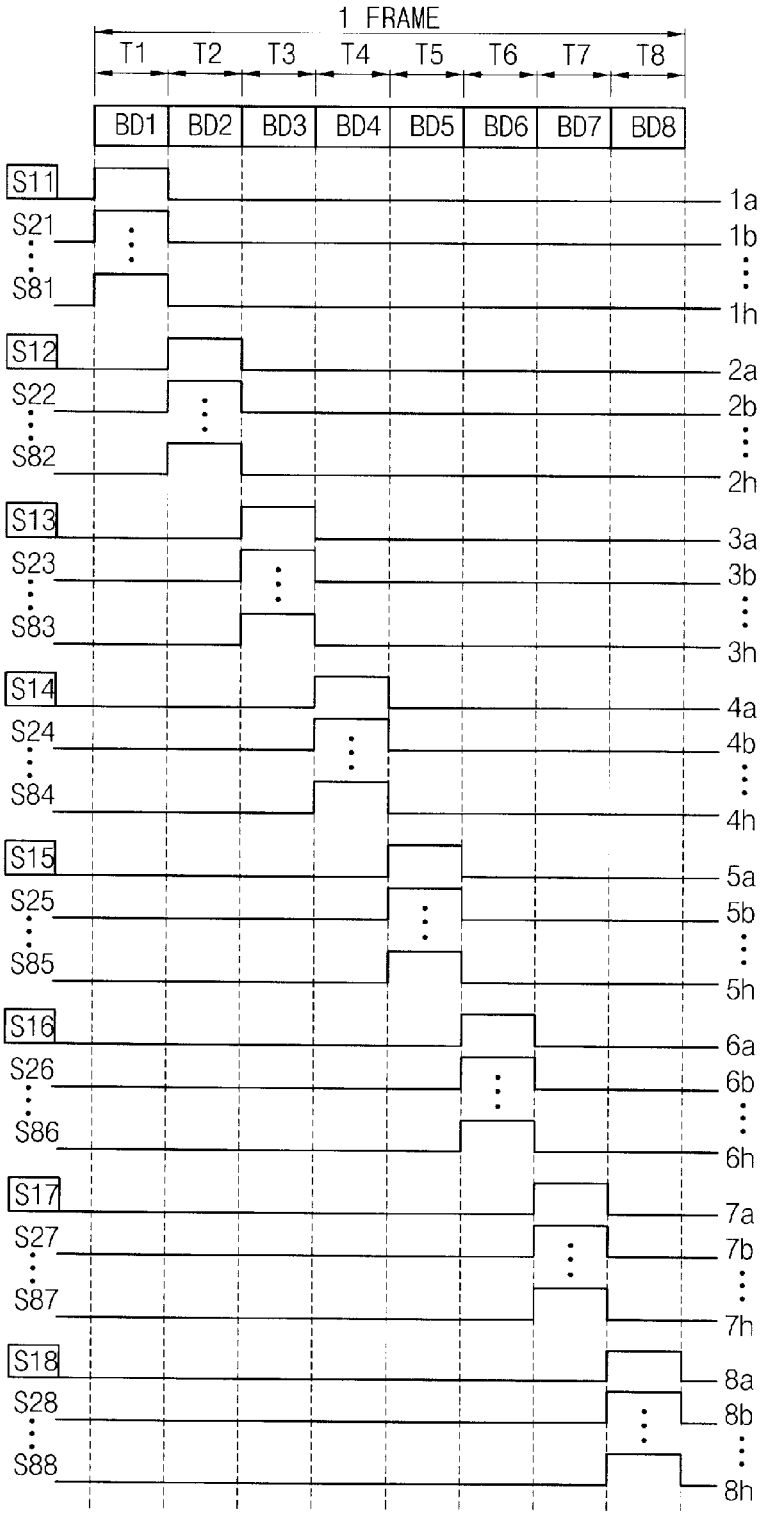
FIG. 6 is a timing diagram illustrating an output signal of the exemplary light-emitting driving part of FIG. 5.

FIG. 6 is a timing diagram illustrating an output signal of the exemplary light-emitting driving part of FIG. 5. Hereinafter, an example in which all of the light-emitting blocks of the light source module 200 emit light is described.

Referring to FIGS. 5 and 6, the driving chip 241 outputs the first to eighth driving signals to the first to eighth driving blocks BD1, . . . , BD8 through the first to eighth output channels 241*a*, 241*b*, . . . , 241*h*.

When the first to eighth switching elements S11, S12, . . . , S18 of the first switching part 242 are turned on, the first light-emitting blocks 1*a*, . . . , 8*a* of the first to eighth driving blocks BD1, . . . , BD8 may receive the first driving signal. Thus, the first light-emitting blocks 1*a*, . . . , 8*a* may emit light when the switching elements S11, S12, . . . , S18 are turned on.

When the first to eighth switching elements S21, S22, . . . , S28 of the second switching part 243 are turned on, the second light-emitting blocks 1*b*, . . . , 8*b* of the first to eighth driving blocks BD1, . . . , BD8 receive the second driving signal. Thus, the second light-emitting blocks 1*b*, . . . , 8*b* may emit light when the switching elements S21, S22, S28 are turned on.

Thus, the first to eighth switching elements S31, S32, . . . , S38 of the third switching part 244 supply the third driving signal to the third light-emitting blocks 1*c*, . . . , 8*c* of the driving blocks BD1, . . . , BD8, the first to eighth switching elements S41, S42, . . . , S48 of the fourth switching part 245 supply the fourth driving signal to the fourth light-emitting blocks 1*d*, . . . , 8*d* of the driving blocks BD1, . . . , BD8, the first to eighth switching elements S51, S52, . . . , S58 of the fifth switching part 246 supply the fifth driving signal to the fifth light-emitting blocks 1*e*, . . . , 8*e* of the driving blocks BD1, . . . , BD8, the first to eighth switching elements S61, S62, . . . , S68 of the sixth switching part 247 supply the sixth driving signal to the sixth light-emitting blocks 1*f*, . . . , 8*f* of the driving blocks BD1, . . . , BD8, the first to eighth switching elements S71, S72, . . . , S78 of the seventh switching part 248 supply the seventh driving signal to the seventh light-emitting blocks 1*g*, . . . , 8*g* of the driving blocks BD1, . . . , BD8, and the first to eighth switching elements S81, S82, . . . , S88 of the eighth switching part 249 supply the eighth driving signal to the eighth light-emitting blocks 1*h*, . . . , 8*h* of the driving blocks BD1, . . . , BD8.

Therefore, the first driving block BD1 is driven for a first interval T1 of one frame, the second driving block BD2 is driven for a second interval T2 of one frame, the third driving block BD3 is driven for a third interval T3 of one frame, the fourth driving block BD4 is driven for a fourth interval T4 of one frame, the fifth driving block BD5 is driven for a fifth interval T5 of one frame, the sixth driving block BD6 is driven for a sixth interval T6 of one frame, the seventh driving block BD7 is driven for a seventh interval T7 of one frame, and the eight driving block BD8 is driven for a eighth interval T8 of one frame. Also, each of the light-emitting blocks may emit light during at least ⅛ of one frame.

Hereinafter, the boosting mode is described. For example, the first light-emitting area may correspond to a display area displaying a white image, and the second light-emitting area may correspond to a display area displaying a black image.

Figure 7A:
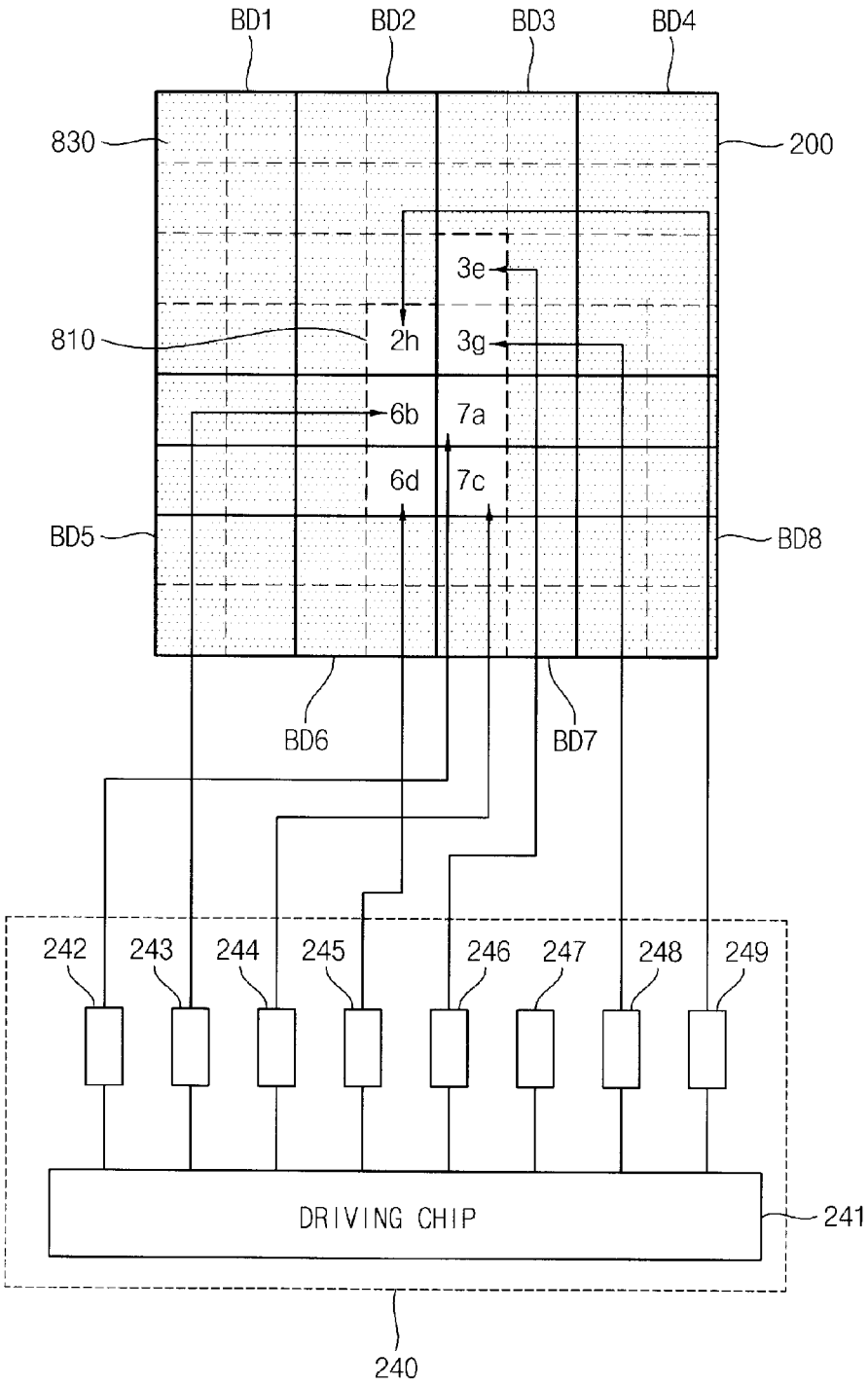
FIG. 7A is a circuit diagram according to a first exemplary embodiment for driving the exemplary light-emitting driving part of FIG. 5.
Figure 7B:
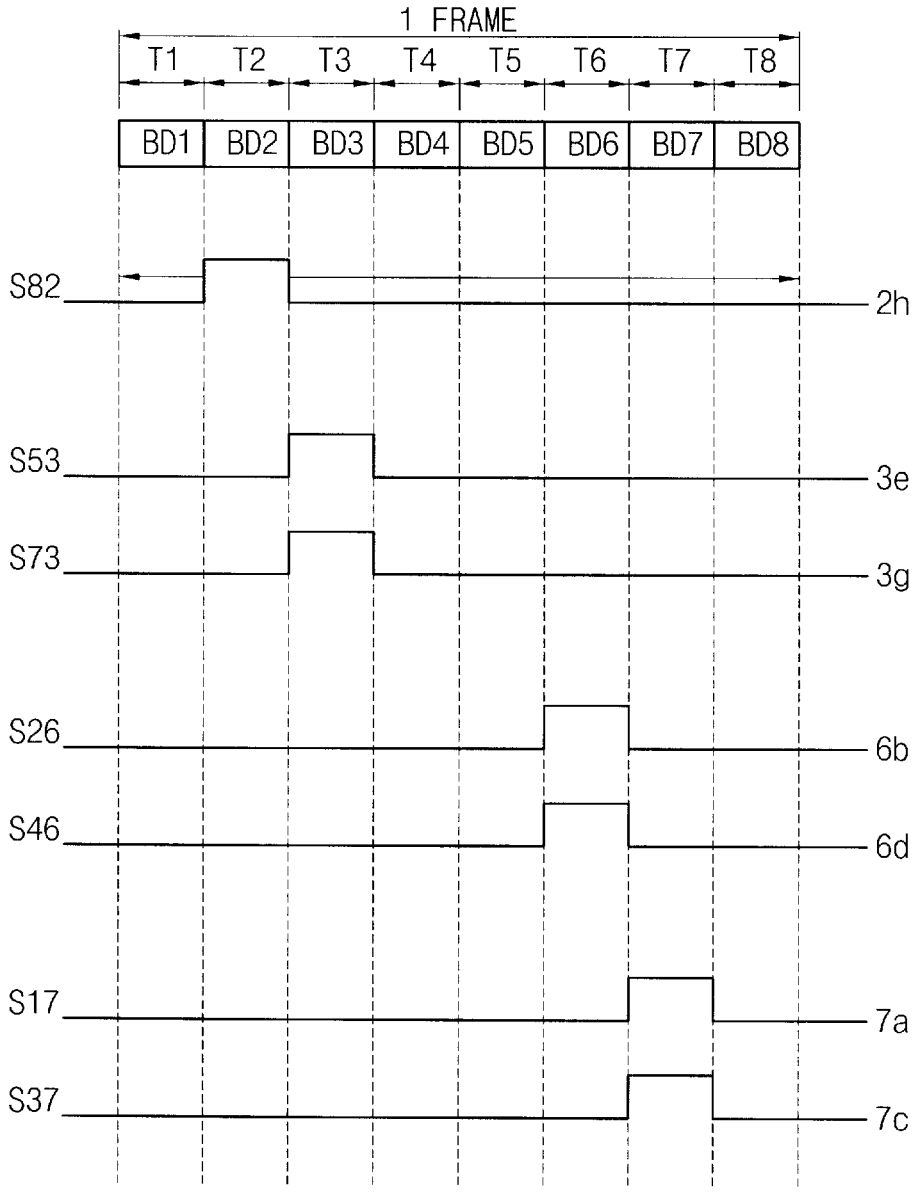
FIG. 7B is a timing diagram illustrating an output signal of the exemplary light-emitting driving part of FIG. 7A.

FIG. 7A is a circuit diagram according to a first exemplary embodiment for driving the exemplary light-emitting driving part of FIG. 5. FIG. 7B is a timing diagram illustrating an output signal of the exemplary light-emitting driving part of FIG. 7A.

Referring to FIGS. 1 and 7A, the area determining part 220 divides the light-emitting blocks B of the light source module 200 into the first light-emitting area 810 and the second light-emitting area 830 by using the representative gray scales of the display blocks and the reference value. The first light-emitting area 810 may have a high luminance, and the second light-emitting area 830 may have a normal luminance.

The first light-emitting area 810 includes the light-emitting blocks having the representative gray scale higher than the reference value, and the second light-emitting area 830 includes the light-emitting blocks having the representative gray scale lower than the reference value.

The first light-emitting area 810 includes the eighth light-emitting block 2*h* of the second driving block BD2, the fifth and seventh light-emitting blocks 3*e* and 3*g* of the third driving block BD3, the second and fourth light-emitting blocks 6*b* and 6*d* of the sixth driving block BD6, and the first and third light-emitting blocks 7*a* and 7*c* of the seventh driving block BD7. The second light-emitting area 830 includes the remaining light-emitting blocks of the light source module 200 except for the light-emitting blocks in the first light-emitting area 810.

The driving chip 241 outputs the first to eighth driving signals through the first output channel to eighth output channels 241*a*, . . . , 214*h*. The first to eighth switching parts 242, . . . , 249 connected to the first to eighth output channels 241*a*, . . . , 214*h* supply the first to eighth driving signals to the light-emitting blocks. The first to eighth switching parts 242, . . . , 249 turn on the switching elements corresponding to the first light-emitting area 810, so that the light-emitting blocks 2*h*, 3*e*, 3*g*, 6*b*, 6*d*, 7*a* and 7*c* in the first light-emitting area 810 emit light. The first to eighth switching parts 242, . . . , 249 turn off the switching elements corresponding to the second light-emitting area 830, so that the light-emitting blocks in the second light-emitting area 830 are turned off.

For example, when the second switching element S82 of the eighth switching part 249 is turned on, the eighth light-emitting block 2*h* of the second driving block BD2 may emit light. When the third switching element S53 of the fifth switching part 246 is turned on, the fifth light-emitting block 3*e* of the third driving block BD3 may emit light. When the third switching element S73 of the seventh switching part 248 is turned on, the seventh light-emitting block 3*g* of the third driving block BD3 may emit light. Thus, when the sixth switching element S26 of the second switching part 243, the seventh switching element S17 of the first switching part 242, the sixth switching element S46 of the fourth switching part 245 and the seventh switching element S37 of the third switching part 244 are turned on, the light-emitting blocks 6*b*, 7*a*, 6*d*, and 7*c* may emit light.

When the switching elements electrically connected to the light-emitting blocks of the second light-emitting area 830 are turned off, the light-emitting blocks of the second light-emitting area 830 are turned off. That is, the second light-emitting area 830 corresponds to a display area displaying a black image, so that the light-emitting blocks of the second light-emitting area 830 are turned off.

However, when the second light-emitting area 830 corresponds to a display area displaying an image having the middle gray scale, the switching elements electrically connected to the light-emitting blocks of the second light-emitting area 830 are turned on. The light-emitting blocks of the second light-emitting area 830 may emit light having a luminance corresponding to the second luminance level. The second luminance level may be separately determined corresponding to each of the light-emitting blocks in the second light-emitting area 830.

As shown in FIG. 7B, each of the light-emitting blocks 2*h*, 3*e*, 3*g*, 6*b*, 6*d*, 7*a* and 7*c* of the first light-emitting area 810 may emit light during at least ⅛ of a frame.

A turn-on time of the switching elements S82, S53, S73, S26, S46, S17 and S37 supplying the driving signal to the light-emitting blocks 2*h*, 3*e*, 3*g*, 6*b*, 6*d*, 7*a* and 7*c* may be extended, so that the luminance of the first light-emitting area 810 may be boosted.

For example, referring to FIGS. 1 and 2, the size of the first light-emitting area 810 may be about 11% with respect to the entire light-emitting area of the light source module 200, so that the luminance determining part 220 determines the first luminance level to be about 130. The light-emitting driving part 240 extends the turn-on time of the switching elements S82, S53, S73, S26, S46, S17 and S37 supplying the driving signal to the first light-emitting area 810 based on the first luminance level, so that the first light-emitting area 810 may be boosted to a luminance corresponding to the first luminance level.

When the turn-on time of the switching elements S82, S53, S73, S26, S46, S17 and S37 is extended by one frame, respectively, the first light-emitting area 810 may be boosted to a maximum luminance level of about 160. Otherwise, when the turn-on time of the switching elements S82, S53, S73, S26, S46, S17 and S37 is extended by about 80% of one frame, respectively, the first light-emitting area 810 may be boosted to a maximum luminance level of about 130.

Figure 8A:
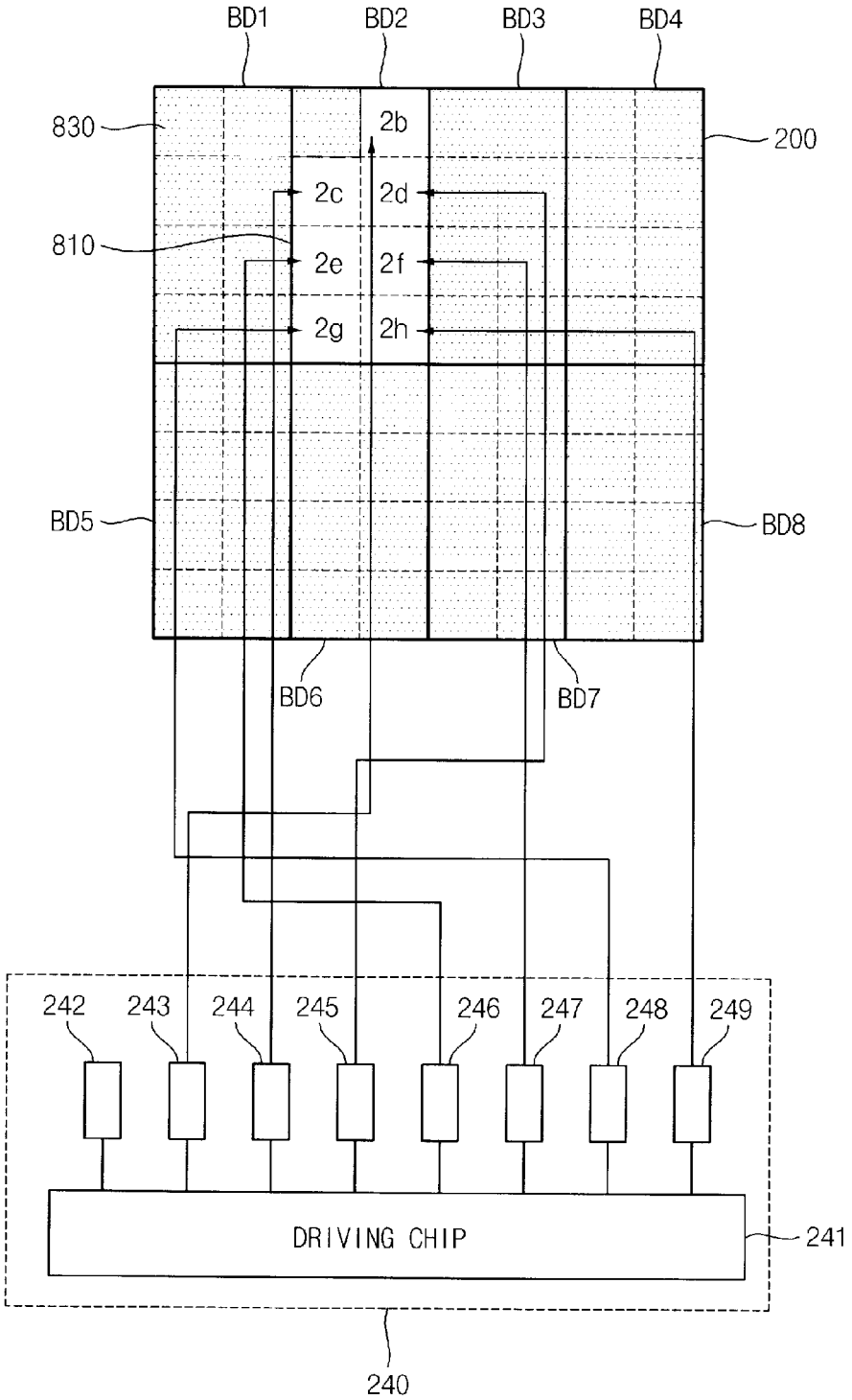
FIG. 8A is a circuit diagram according to a second exemplary embodiment for driving the exemplary light-emitting driving part of FIG. 5.
Figure 8B:
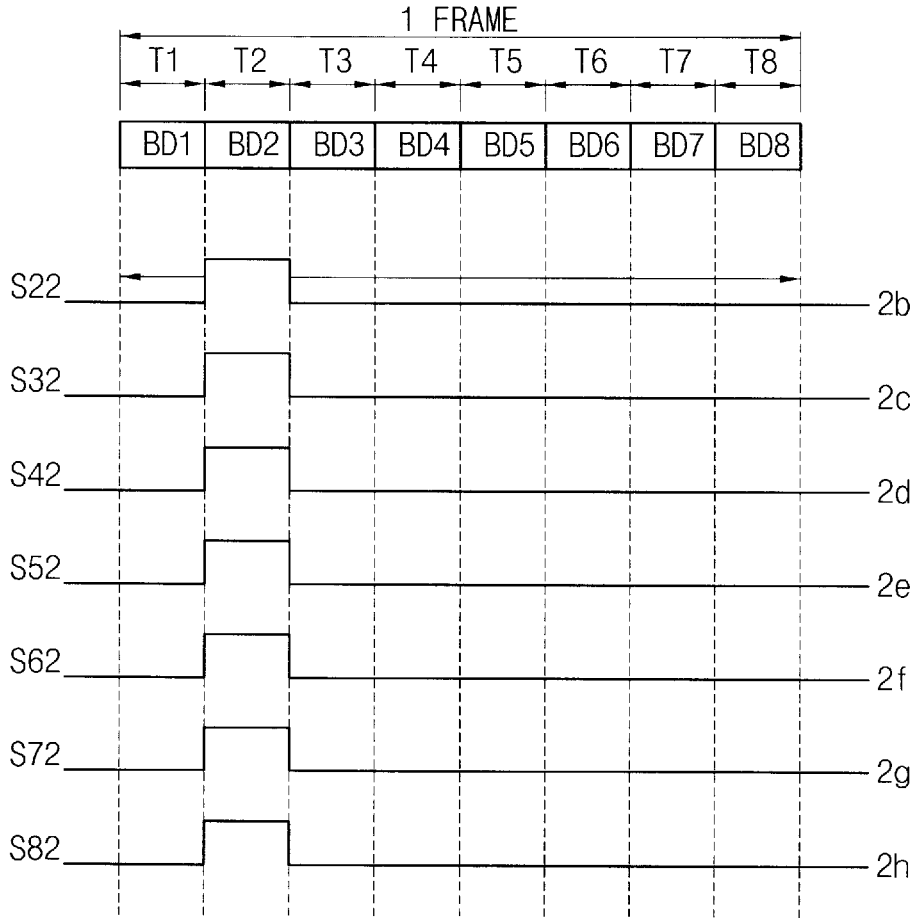
FIG. 8B is a timing diagram illustrating an output signal of the exemplary light-emitting driving part of FIG. 8A.

FIG. 8A is a circuit diagram according to a second exemplary embodiment for driving the exemplary light-emitting driving part of FIG. 5. FIG. 8B is a timing diagram illustrating an output signal of the exemplary light-emitting driving part of FIG. 8A.

Referring to FIGS. 8A and 8B, the first light-emitting area 810 includes the second, third, fourth, fifth, sixth, seventh and eighth light-emitting blocks 2*b*, 2*c*, 2*d*, 2*f*, 2*g* and 2*h* of the second driving block BD2. The second light-emitting area 830 includes the remaining light-emitting blocks of the light source module 200 except for the light-emitting blocks in the first light-emitting area 810.

When the second switching element S22 of the second switching part 243 is turned on, the second light-emitting block 2*b* of the second driving block BD2 may emit light. When the second switching element S32 of the third switching part 244 is turned on, the third light-emitting block 2*c* of the second driving block BD2 may emit light. When the second switching element S42 of the fourth switching part 245 is turned on, the fourth light-emitting block 2*d* of the second driving block BD2 may emit light. Thus, when the second switching element S52 of the fifth switching part 246, the second switching element S62 of the sixth switching part 247, the second switching element S72 of the seventh switching part 248, and the second switching element S82 of the eighth switching part 249 are turned on, the fifth, sixth, seventh, and eighth light-emitting blocks 2*e*, 2*f*, 2*g*, and 2*h* may emit light.

The light-emitting driving part 240 extends the turn-on time of the switching elements S22, S32, S42, S52, S62, S72 and S82 by a maximum of one frame, so that the first light-emitting area 810 may be boosted to a luminance corresponding to the first luminance level.

Figure 9A:
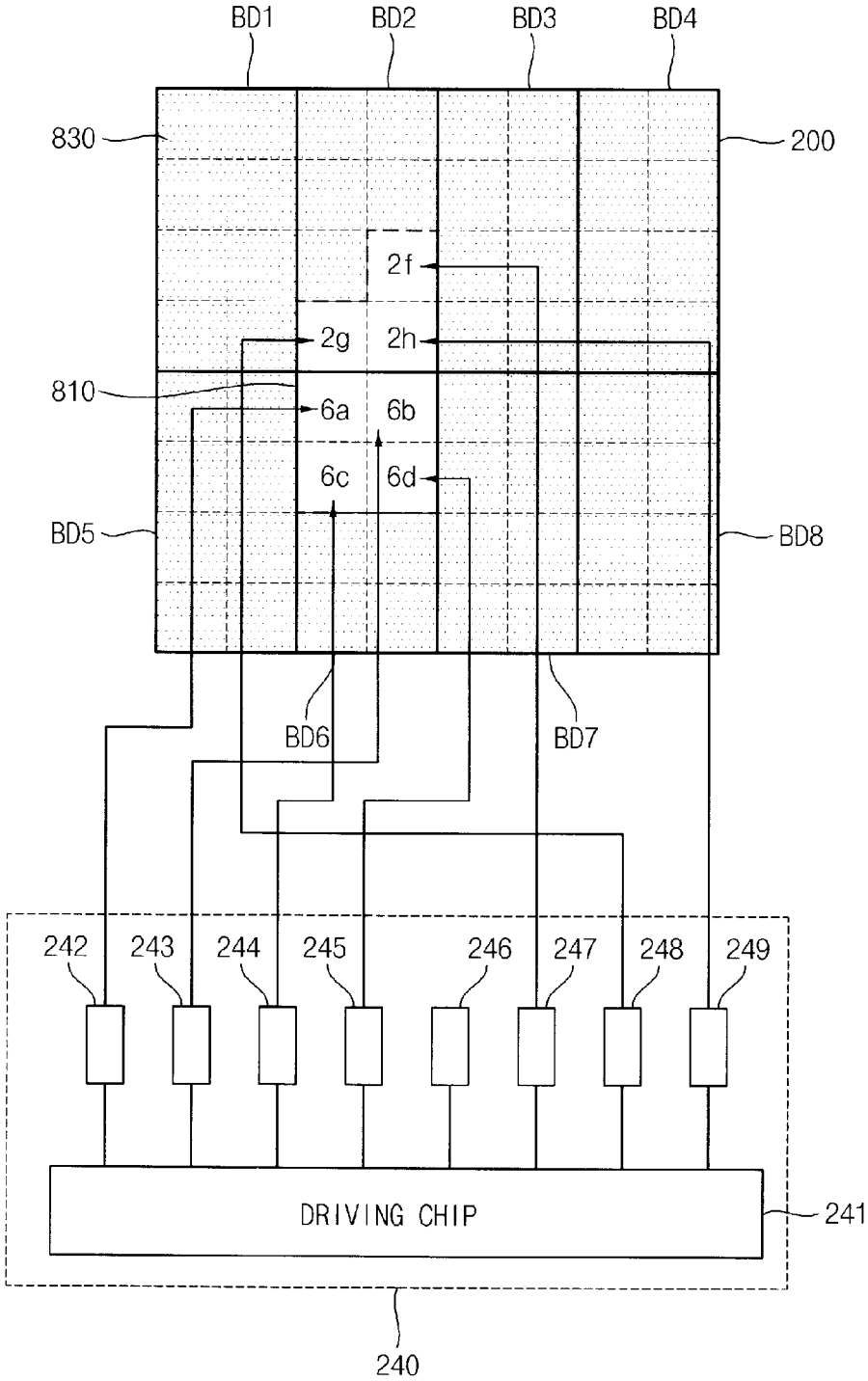
FIG. 9A is a circuit diagram according to a third exemplary embodiment for driving the exemplary light-emitting driving part of FIG. 5.
Figure 9B:
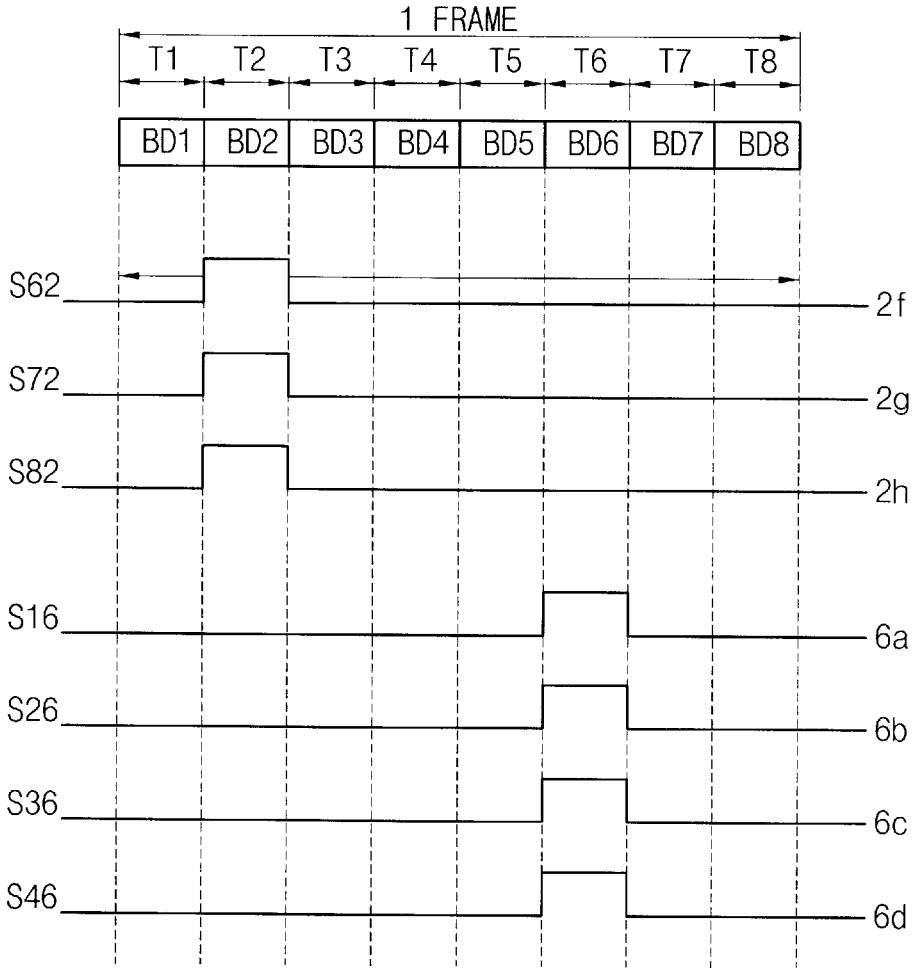
FIG. 9B is a timing diagram illustrating an output signal of the exemplary light-emitting driving part of FIG. 9A.

FIG. 9A is a circuit diagram according to a third exemplary embodiment for driving the exemplary light-emitting driving part of FIG. 5. FIG. 9B is a timing diagram illustrating an output signal of the exemplary light-emitting driving part of FIG. 9A.

Referring to FIGS. 9A and 9B, the first light-emitting area 810 includes the sixth, seventh and eighth light-emitting blocks 2*f*, 2*g* and 2*h* of the second driving block BD2 and the first, second, third and fourth light-emitting blocks 6*a*, 6*b*, 6*c* and 6*d* of the sixth driving block BD6.

When the second switching element S62 of the sixth switching part 247 is turned on, the sixth light-emitting block 2*f* of the second driving block BD2 may emit light. When the second switching element S72 of the seventh switching part 248 is turned on, the seventh light-emitting block 2*g* of the second driving block BD2 may emit light. When the second switching element S82 of the eighth switching part 249 is turned on, the eighth light-emitting block 2*h* of the second driving block BD2 may emit light. Thus, when the sixth switching element S16 of the first switching part 242, the sixth switching element S26 of the second switching part 243, the sixth switching element S36 of the third switching part 244, and the sixth switching element S46 of the fourth switching part 245 are turned on, the first, second, third and fourth light-emitting blocks 6*a*, 6*b*, 6*c* and 6*d* may emit light.

The light-emitting driving part 240 extends the turn-on time of the switching elements S62, S72, S82, S16, S26, S36 and S46 by a maximum of one frame, so that the first light-emitting area 810 may be boosted to a luminance corresponding to the first luminance level.

Figure 10:
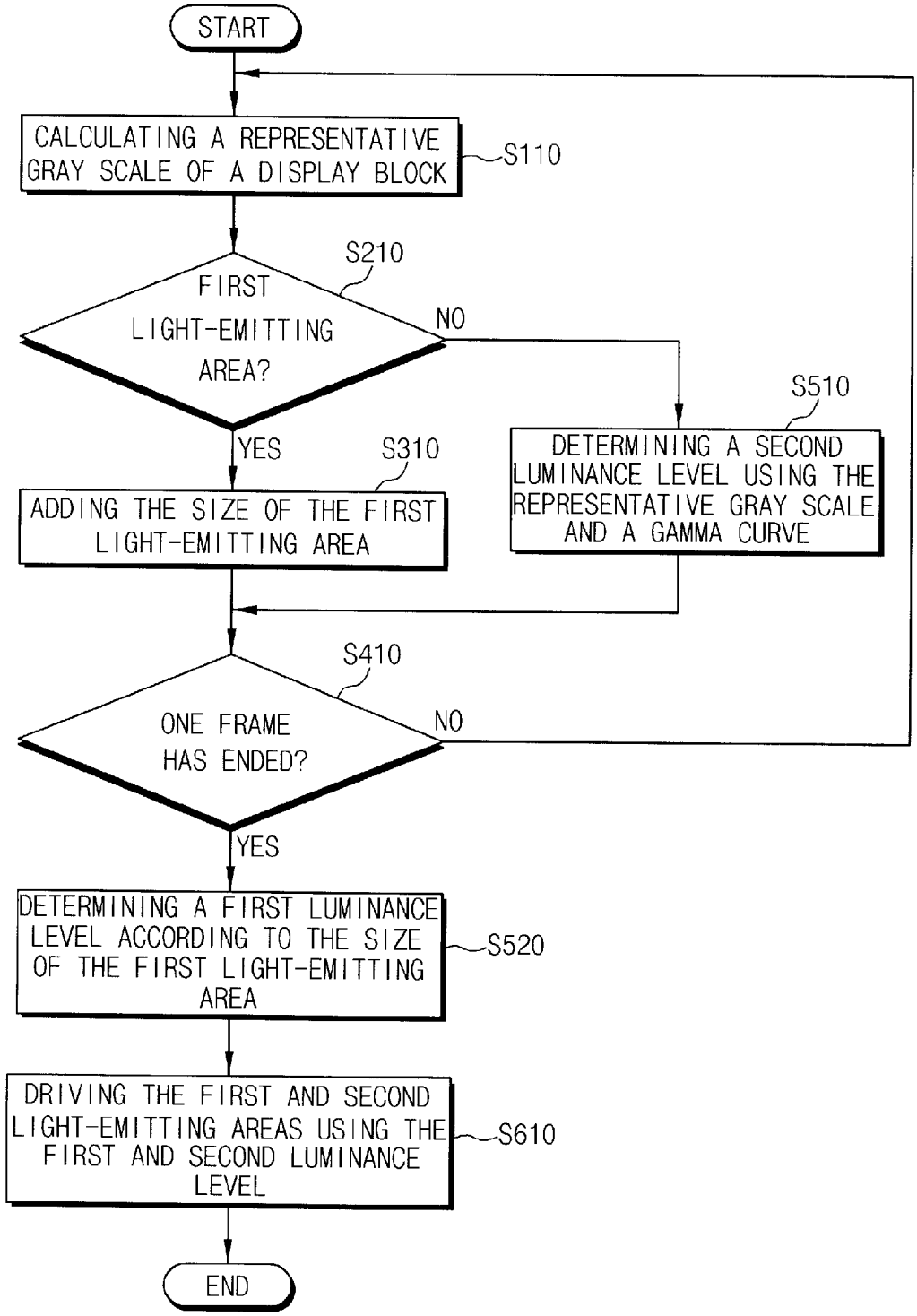
FIG. 10 is a flowchart showing an exemplary method of driving the exemplary local dimming driving part of FIG. 1.

FIG. 10 is a flowchart showing an exemplary method of driving an exemplary local dimming driving part of FIG. 1.

Referring to FIG. 10, and with reference to FIG. 1, the representative calculating part 210 calculates a representative gray scale of the display block D corresponding to the light-emitting block B by using the image signal (step S110). The representative gray scale may be an average gray scale, a maximum gray scale, a minimum gray scale, a root-mean-square value of individual gray etc. The representative gray scale may be determined by various formulas.

The area determining part 220 divides the light-emitting blocks B of the light source module 200 into the first light-emitting area and the second light-emitting area by using the representative gray scales of the display blocks D and the reference value. For example, when the representative gray scale of a particular display block D is higher than the reference value, the area determining part 220 may determine a corresponding light-emitting block B to be a first light-emitting area that has a maximum luminance. When the representative gray scale of a particular display block D is lower than the reference value, the area determining part 220 may determine the corresponding light-emitting block B to be a second light-emitting area that has a normal luminance (step S210). The reference value may be a white gray scale, the maximum luminance may be the luminance of an image having the white gray scale, and the normal luminance may be the luminance of an image having a middle gray scale.

The area determining part 220 adds the size of the light-emitting block or blocks which the representative gray scales higher than the reference value (step S310), which is determined to be the first light-emitting area. The step of adding the size of the light-emitting blocks is repeated during one frame (step S410).

The luminance determining part 230 determines the second luminance level of the light-emitting block or blocks to be the second light-emitting area (step S510). The second luminance level is determined by using the representative gray scales of the light-emitting block or blocks and the gamma curve. The gamma curve includes the relation between the representative gray scale and a luminance. In addition, the luminance determining part 230 may compensate the second luminance level by various modes using the luminance level of peripheral light-emitting blocks. For example, the second luminance level of the light-emitting blocks may be compensated by using a compensating matrix having a size such as 3×3, 16×16, P×Q (wherein P and Q are natural numbers), etc.

The luminance determining part 230 determines the first luminance level of the first light-emitting area according to the size of the first light-emitting area with respect to the size of the entire light-emitting area of the light source module 200 (step S520). The first luminance level becomes larger as the size of the first light-emitting area becomes smaller, and the first luminance level becomes smaller as the size of the first light-emitting area becomes larger.

The light-emitting driving part 240 drives the light-emitting block or blocks of the first light-emitting area using the first luminance level, and the light-emitting block or blocks of the second light-emitting area using the second luminance level (step S610). The driving method of the light-emitting driving part 240 is substantially the same as the description referring to FIGS. 5 to 9*b*, and any further repetitive explanation concerning the driving method will be omitted.

Figure 11:
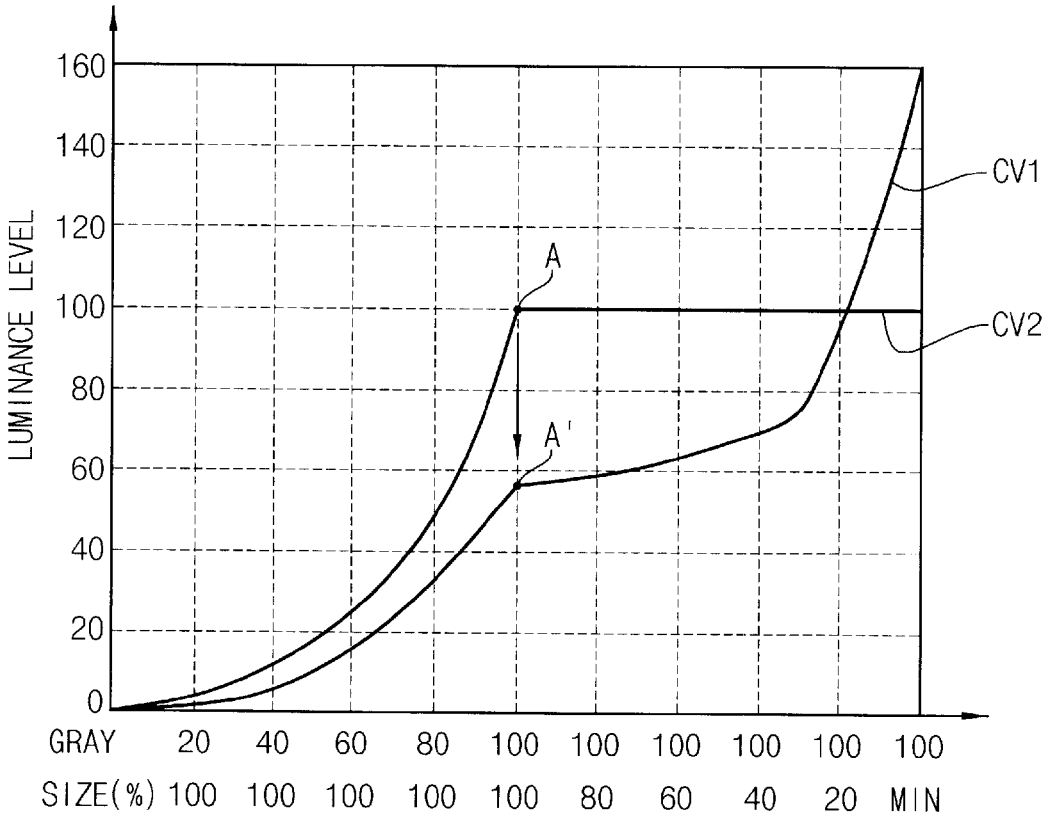
FIG. 11 is a graph illustrating the relation between the size and the luminance of light-emitting area.

FIG. 11 is a graph illustrating the relation between the size and the luminance of the light-emitting areas.

Referring to FIG. 11, a first curve CV1 is a graph illustrating the relation between the size and the luminance of the light-emitting areas according to an exemplary LCD apparatus of the exemplary embodiment. A second curve CV2 is a graph illustrating the relation between the size and the luminance of the light-emitting areas according to the LCD apparatus of the comparative example.

The first curve CV1 is compared with the second curve CV2. In the second curve CV2, a luminance level was fixed at about '100' regardless of the size of the light-emitting area when the maximum of the representative gray scale was '100'. However, in the first curve CV1, a luminance level was variable with respect to the size of the light-emitting area when the maximum of the representative gray scale was '100'. That is, when the maximum of the representative gray scale was '100', when the size of the light-emitting area became smaller, the luminance level became larger, similar to an exponential curve. When the size of the light-emitting area became larger, the luminance level became smaller, similar to an exponential curve.

In the LCD apparatus of the comparative example, the luminance level of the maximum light-emitting area was always about '100' regardless of the size of the maximum light-emitting area being decreased, in which the display block of the display panel had the representative gray scale higher than the reference value. However, in the LCD apparatus of the exemplary embodiment, the luminance level of the maximum light-emitting area was increased as the size of the maximum light-emitting area was decreased, in which the display block of the display panel had the representative gray scale higher than the reference value. Therefore, the LCD apparatus of the exemplary embodiment may have an enhanced contrast ratio in comparison with the LCD apparatus of the comparative example.

In addition, the luminance level of a point A at which the size of the maximum light-emitting area was the maximum was about '100' in the second curve CV2, and the luminance level of a point A' at which the size of the maximum light-emitting area was the maximum was about '55' in the first curve CV1. Therefore, the LCD apparatus of the exemplary embodiment may produce reduced glare in comparison with the LCD apparatus of the comparative example.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be in within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be in within the scope of the appended claims. The present invention is defined by the following claims, with equivalents of the claims to be in therein.

What is claimed is:

1. A method of local dimming a light source, the method comprising:

driving a light source including a plurality of driving blocks having an I×J matrix structure, wherein I and J are natural numbers, each of the driving blocks having light-emitting blocks having an i×j matrix structure, wherein i and j are natural numbers;

generating a number of i×j driving signals corresponding to a number of the I×J driving blocks;

time-sharing each of the number of i×j driving signals to sequentially supply and individually control a corresponding light-emitting block of each of the number of the I×J driving blocks and emit light from the corresponding light-emitting block when a corresponding switching element is turned on, wherein each of first driving signals of the number of the i×j driving signals is supplied to each of first light emitting blocks of the number of the I×J driving blocks and each of second driving signals of the number of the i×j driving signals is supplied to each of second light emitting blocks of the number of the I×J driving blocks; and adjusting luminance of a first light-emitting area according to a size of the first light-emitting area corresponding to a display area in which an image having a maximum luminance is displayed.

2. The method of claim 1, wherein the luminance of the first light-emitting area increases as the size of the first light-emitting area decreases, and the luminance of the first light-emitting area decreases as the size of the first light-emitting area increases.

3. The method of claim 1, further comprising:

determining a light-emitting block corresponding to a representative gray scale to be on the first light-emitting area when the representative gray scale is greater than a set reference value;

determining a first luminance level of the first light-emitting area according to the size of the first light-emitting area; and driving the light-emitting block corresponding to the first light-emitting area by using the first luminance level, wherein the first luminance level is set to be larger as the size of the first light-emitting area is decreased, and is set to be smaller as the size of the first light-emitting area is increased.

4. The method of claim 3, wherein the first luminance level is a maximum value when the size of the first light-emitting area is a minimum value.

5. The method of claim 1, wherein one frame includes I×J intervals, and a time-shared driving signal is applied to one light-emitting block in one driving block during one interval.

6. The method of claim 5, wherein said time-sharing each of the number of i×j driving signals to supply the driving blocks includes:

applying the time-shared driving signal to the light-emitting block in the first light-emitting area during a maximum interval extended a number of I×J times.

7. The method of claim 3, further comprising:

determining a light-emitting block corresponding to a representative gray scale to be in a second light-emitting area when the representative gray scale is lower than a reference value;

determining a second luminance level of the light-emitting block in the second light-emitting area by using the representative gray scale and a gamma curve; and driving the light-emitting block corresponding to the second light-emitting area by using the second luminance level.

8. A light source apparatus comprising:

a light source module comprising a plurality of driving blocks having an I×J matrix structure, wherein I and J are natural numbers, each of the driving blocks having light-emitting blocks having an i×j matrix structure, wherein i and j are natural numbers, and the light source module supplies light to a display panel; and a local dimming driving part adjusts a luminance of a first light-emitting area according to a size of the first light-emitting area corresponding to an area of the display panel in which an image having a maximum luminance is displayed; the local dimming driving part including a light-emitting driving part comprising:

a driving chip including a number of i×j output channels, which outputs a number of i×j driving signals through the number of the i×j output channels; and a number of i×j switching parts each including a number of i×j switching elements, the switching elements being parallelly connected to each of the output channels, wherein the switching elements time-shares a driving signal outputted from the output channel to sequentially supply and individually control a corresponding light-emitting block of each of a number of the I×J driving blocks and emit light from the corresponding light-emitting block when a corresponding switching element is turned on, wherein each of first driving signals of the number of the i×j driving signals is supplied to each of first light emitting blocks of the number of the I×J driving blocks and each of second driving signals of the number of the i×j driving signals is supplied to each of second light emitting blocks of the number of the I×J driving blocks.

9. The light source apparatus of claim 8, wherein the local dimming driving part further comprises:

a representative calculating part which calculates representative gray scale of an image corresponding to a light-emitting block;

an area determining part which determines the light-emitting block to be in the first light-emitting area when the representative gray scale is greater than a set reference value;

a luminance determining part which determines a first luminance level of the first light-emitting area according to the size of the first light-emitting area, wherein the first luminance level is set to be larger as the size of the first light-emitting area is decreased, and is set to be smaller as the size of the first light-emitting area is increased; and the light-emitting driving part which drives the light-emitting block in the first light-emitting area by using the first luminance level.

10. The light source apparatus of claim 9, wherein the area determining part determines a light-emitting block corresponding to a representative gray scale to be in a second light-emitting area when the representative gray scale is lower than a reference value, the luminance determining part determines a second luminance level of the light-emitting block to be in the second light-emitting area by using the representative gray scale and a gamma curve, and the light-emitting driving part drives the light-emitting block in the second light-emitting area by using the second luminance level.

11. The light source apparatus of claim 8, wherein one frame includes I×J intervals, one of the switching elements turns on during one interval, so that the time-shared driving signal is applied to one light-emitting block in one driving block.

12. The light source apparatus of claim 11, wherein the light-emitting driving part controls a switching element connected to the light-emitting block in the first light-emitting area to apply the time-shared driving signal to the light-emitting block in the first light-emitting area during a maximum interval extended a number of I×J times, so that the luminance of the first light-emitting area is increased.

13. A display apparatus comprising:

a display panel comprising a plurality of display blocks to display images;

a light source module supplying light to the display panel, comprising a plurality of light-emitting blocks in correspondence with the display blocks;

a local dimming driving part adjusting the luminance of a first light-emitting area of the light source module according to a size of the first light-emitting area corresponding to an area of the display panel in which an image having a maximum luminance is displayed, wherein the light source module includes a plurality of driving blocks having an I×J matrix structure, wherein I and J are natural numbers, each of the driving blocks having the light-emitting blocks having an i×j matrix structure wherein i and j are natural numbers, wherein the local dimming driving part comprises:

a driving chip including a number of i×j output channels, outputting a number of i×j driving signals through the i×j output channels; and a number of i×j switching parts each including a number of I×J switching elements, the switching elements of each switching part parallel connected to a corresponding one of the output channels, wherein the switching elements time-shares a driving signal outputted from the corresponding output channel to the number of the I×J driving blocks to sequentially supply and individually control a corresponding light-emitting block of each of the number of the I×J driving blocks and emit light from the corresponding light-emitting block when a corresponding switching element connected to the corresponding light-emitting block is turned on, wherein each of first driving signals of the number of the i×j driving signals is supplied to each of first light emitting blocks of the number of the I×J driving blocks and each of second driving signals of the number of the i×j driving signals is supplied to each of second light emitting blocks of the number of the I×J driving blocks.

14. The display apparatus of claim 13, wherein the local dimming driving part comprises:

a representative calculating part which calculates representative gray scale of an image corresponding to a light-emitting block;

an area determining part which determines the light-emitting block to be in the first light-emitting area when the representative gray scale is greater than a reference value;

a luminance determining part which determines a first luminance level of the first light-emitting area according to the size of the first light-emitting area, wherein the first luminance level is set to be larger as the size of the first light-emitting area is decreased, and is set to be smaller as the size of the first light-emitting area is increased; and a light-emitting driving part which drives the light-emitting block in the first light-emitting area by using the first luminance level.

15. The display apparatus of claim 13, wherein one frame includes I×J intervals, one of the switching elements turns on during one interval, so that the time-shared driving signal is applied to one light-emitting block in one driving block.

16. The display apparatus of claim 15, wherein the light-emitting driving part controls a switching element connected to the light-emitting block in the first light-emitting area to apply the time-shared driving signal to the light-emitting block in the first light-emitting area during a maximum interval extended a number of I×J times, so that the luminance of the first light-emitting area is increased.

17. A method of local dimming a light source, the method comprising:

driving a light source including a plurality of driving blocks having an I×J matrix structure, wherein I and J are natural numbers, each of the driving blocks having light-emitting blocks having an i×j matrix structure, wherein i and j are natural numbers;

generating a number of i×j driving signals; and time-sharing each of the number of i×j driving signals to sequentially supply and individually control a corresponding light-emitting block of each of a number of the I×J driving blocks and emit light from the corresponding light-emitting block when a corresponding switching element connected to the corresponding light-emitting block is turned on, wherein each of first driving signals of the number of the i×j driving signals is supplied to each of first light emitting blocks of the number of the I×J driving blocks and each of second driving signals of the number of the i×j driving signals is supplied to each of second light emitting blocks of the number of the I×J driving blocks.

18. The method of claim 17, wherein one frame includes I×J intervals, and the time-shared driving signal is supplied to one light-emitting block in one driving block during one interval.

19. The method of claim 18, wherein time-sharing each of the i×j driving signals to supply the driving blocks includes:

applying the time-shared driving signal to the light-emitting block in the first light-emitting area during a maximum interval extended I×J times.

* * * * *